United States Patent [19]

Kichizo et al.

[11] Patent Number: 5,062,373

[45] Date of Patent: Nov. 5, 1991

[54] BUTTON TRANSFERRING DEVICE

[75] Inventors: Maeno Kichizo; Junpei Arai, both of Tendou; Hideo Aso, Chofu, all of Japan

[73] Assignee: Juki Corporation, Tokyo, Japan

[21] Appl. No.: 574,442

[22] Filed: Aug. 28, 1990

[30] Foreign Application Priority Data

| | | | |
|---|---|---|---|
| Aug. 31, 1989 | [JP] | Japan | 1-226975 |
| Sep. 18, 1989 | [JP] | Japan | 1-242875 |
| Sep. 18, 1989 | [JP] | Japan | 1-242876 |
| Sep. 18, 1989 | [JP] | Japan | 1-242883 |

[51] Int. Cl.[5] ..... D05B 3/22; B65H 7/02; B23Q 7/12

[52] U.S. Cl. ..... 112/113; 221/168

[58] Field of Search ..... 112/70, 104, 110, 113-115, 112/257; 221/156, 163, 164, 167, 168, 172, 200, 277

[56] References Cited

U.S. PATENT DOCUMENTS

| | | | |
|---|---|---|---|
| 1,008,032 | 11/1911 | Hastings | 221/168 |
| 2,665,651 | 1/1954 | Eagle | 112/113 X |
| 2,921,544 | 1/1960 | Willis et al. | 112/113 |
| 2,966,125 | 12/1960 | Stott | 221/156 X |
| 3,269,514 | 8/1966 | Daniels et al. | 112/113 X |
| 3,670,673 | 6/1972 | Winston et al. | 112/113 |
| 3,889,612 | 6/1975 | Hughes et al. | 112/113 |
| 4,594,953 | 6/1986 | Ando et al. | 112/113 X |
| 4,651,657 | 3/1987 | Kennedy | 112/113 |
| 4,714,034 | 12/1987 | Riss et al. | 112/113 |

FOREIGN PATENT DOCUMENTS

| | | | |
|---|---|---|---|
| 3519659 | 5/1987 | Fed. Rep. of Germany . | |
| 7533526 | 11/1976 | France | 112/113 |
| 373643 | 1/1960 | Japan . | |
| 1025598 | 5/1989 | Japan . | |

*Primary Examiner*—Werner H. Schroeder
*Assistant Examiner*—Ismael Izaguirre
*Attorney, Agent, or Firm*—Morgan & Finnegan

[57] ABSTRACT

A device for transferring buttons in succession to a button sewing machine in such a manner that they are forcibly fed from a button storage unit by a rotary disk with button insert holes through which the individual button drops into a button holder when each of the insert holes align with a button discharge hole.

9 Claims, 20 Drawing Sheets

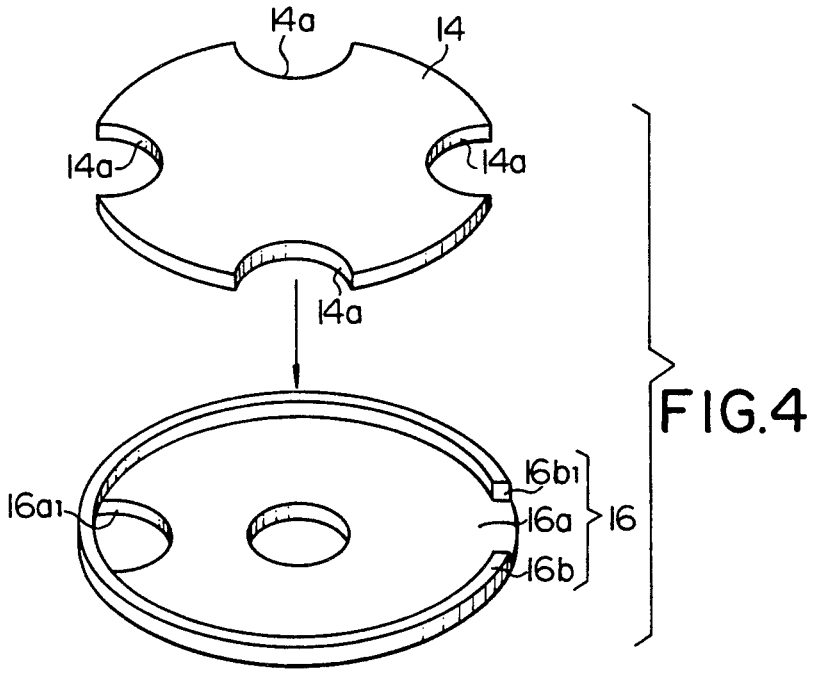
FIG.4
FIG.5A
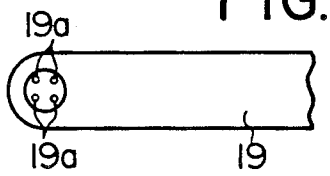
FIG.5B
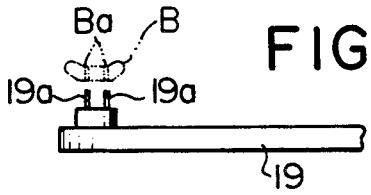

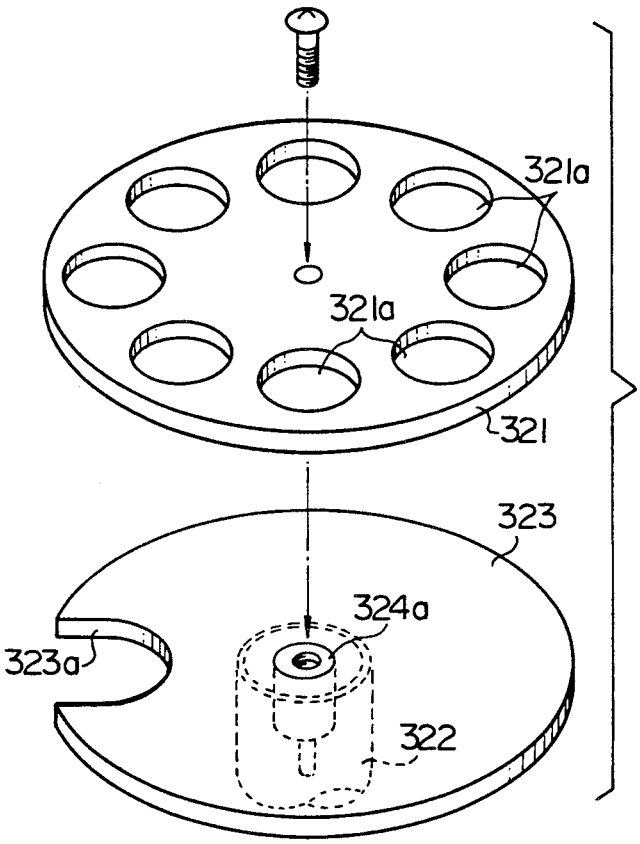
FIG. 17
FIG. 18A
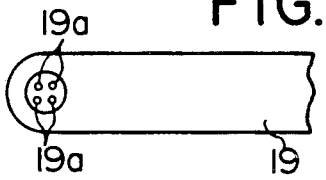
FIG. 18B
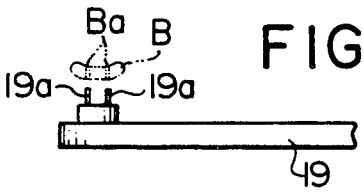

BUTTON TRANSFERRING DEVICE

BACKGROUND OF THE INVENTION

1. Field of the Invention

This invention relates to a button transferring device adapted to successively feed a plurality of buttons to a button sewing machine. More particularly, the invention relates to a button transferring device so arranged as to horizontally transfer the buttons from a button feeder or button storage unit to the button sewing machine.

2. Prior Art

There is presently available a number of button transferring devices for supplying buttons to a button receiving disk of a button sewing machine, some of which are disclosed, for instance, in the following U.S. Pat. Nos. 3,633,524 (issued on Sept. 23, 1970); 3,499,405 (issued on Mar. 10, 1970); 4,651,657 (issued on Mar. 24, 1987); and German Patent Specification No. 16 60 947 (published on July 1, 1976).

These conventional devices have a button transfer path in the form of an inclined chute or the like which is disposed between the button feeder or button storage unit and the button sewing machine.

In general, buttons discharged from the button feeder are gravitationally slid down on the transfer path.

However, a conventional button sewing machine which is adapted to slide the buttons discharged from the button supply station down the path due to gravity occasionally prevents the buttons from smoothly sliding down the path due to button material and weight which may otherwise provide difficulty in supplying the buttons. For instance, if the individual button is lightweight and is formed of a material such as polyethylene which is apt to generate static electricity, the buttons are stacked with each other or adhere to the inside of the path, thereby resulting in clogging preventing the buttons from being properly supplied due to such static electricity generated when they are slid down on the path. This is also the case with the winter where humidity is low. In this instance, not only is labor required to remove the clogged buttons but also the sewing machine may effect a sewing cycle without feeding the buttons to a button clamp of the sewing machine. Thus, undesirable seams may be formed on the fabric piece decreasing productivity.

In order to ensure slide movement of the button from the supply station to the stand-by position, a considerable height differential should be provided. To this end, it is necessary to set the discharge hole of the supply station so as to keep it away from a sewing machine table or work bench as well as being high. Under such circumstances, the operator cannot visually inspect the remainder of the buttons in his normal working position sitting on his chair in front of the sewing machine table or work bench. This renders it impossible for the operator to inspect how many buttons remain unless he stands up from his chair.

SUMMARY OF THE INVENTION

With the foregoing in mind, it is an object of the invention to provide a button transferring device which is capable of steadily feeding the respective buttons to a sewing machine and allowing ready inspection of the remainder of the buttons in the button supply station thereby improving productivity and workability.

The foregoing and other objects of the invention are attained by providing a button transferring device for transferring the button from a storage unit to a sewing machine, which preferably comprises a button clamping device provided to the sewing machine, a rotary disk having a plurality of button insert holes, a drive motor driving the rotary disk horizontally and intermittently, a button receiving disk positioned under the rotary disk for receiving the button thereon, the receiving disk having a button discharge hole which communicates with the button insert holes of the rotary disk to discharge the button, and an arm horizontally movable between the button discharge hole and the clamping device, the arm having a button holder at its top end for holding the button discharged form the button receiving disk.

The button transferring device of the invention is designed such that the buttons are moved horizontally by a button conveyor system and then to a button clamp of the button sewing machine by a swivel arm so that the buttons may be supplied to the sewing machine without fail irrespective of button material and button weight. Further, the supply path extending from the button feeder to the sewing machine is made substantially horizontal to make the button feeder substantially flush with the button clamp, that is, the button feeder is positioned in an extremely low position.

In accordance with the invention, there is provided a button transferring device which preferably further comprises a controller to exchange a rotating direction of the rotary disk, the button receiving disk further including a second button discharge hole positioned between the first button discharge hole and the storage unit. The button transferring device of the invention is fabricated such that an individual button which is stayed in a recess or button inserting hole in a rotary plate may be discharged by inversely rotating the rotary plate so that the button is efficiently changed to a different type of the button.

According to the invention, there is provided a button transferring device which preferably further comprises a photosensor to detect whether a button is in the button insert hole, and a controller to stop the sewing machine when the button exists in the button insert hole. The button transferring device of the invention is also capable of preventing the sewing machine from doing a loose sewing even if the buttons are fed to the inside of the recesses in the rotary plate.

In accordance with the invention, there is provided a button transferring device which preferably further comprises a button alignment mechanism including a pair of plates to horizontally hold the button delivered from the button discharge hole, a rotary presser movable vertically to press the button while rotating the same button, and centering means for aligning the button on the plates with the rotary presser. The button transferring device of the invention is capable of engaging the buttons in pegs of the swivel arm or arm.

BRIEF DESCRIPTION OF THE DRAWINGS

The accompanying drawings, referred to herein and constituting a part hereof, illustrate preferred embodiments of the invention and, together with the description, serve to explain the principles of the invention, wherein:

FIG. 4 is an exploded perspective view showing a rotary plate and a button support or button receive disk according to the first embodiment of the invention;

FIG. 5A is a plan view showing a tip end of a swivel arm according to the first embodiment of the invention;

FIG. 5B is a front elevation showing that tip end of the swivel arm in accordance with the first embodiment of the invention;

FIG. 17 is an exploded perspective view of a second rotary conveyance in accordance with the fourth embodiment of the invention;

FIG. 18A is a plan view showing a tip end of a swivel arm according to the fourth embodiment of the invention;

FIG. 18B is a front view showing the tip end of a swivel arm according to the fourth embodiment of the invention;

DETAILED DESCRIPTION OF THE DRAWINGS

Figure 1:
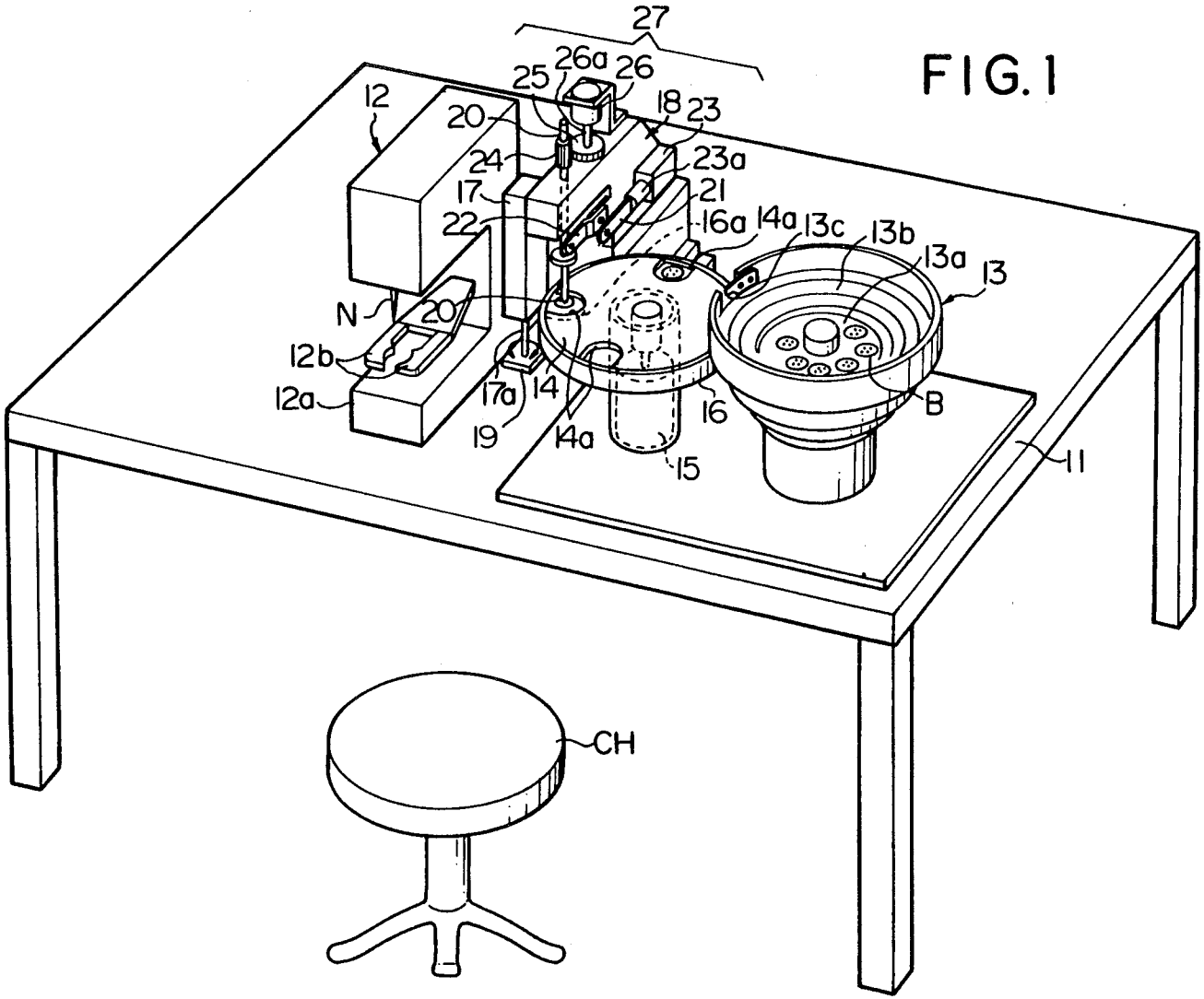
FIG. 1 is a perspective view showing a first embodiment of the present invention.
Figure 2:
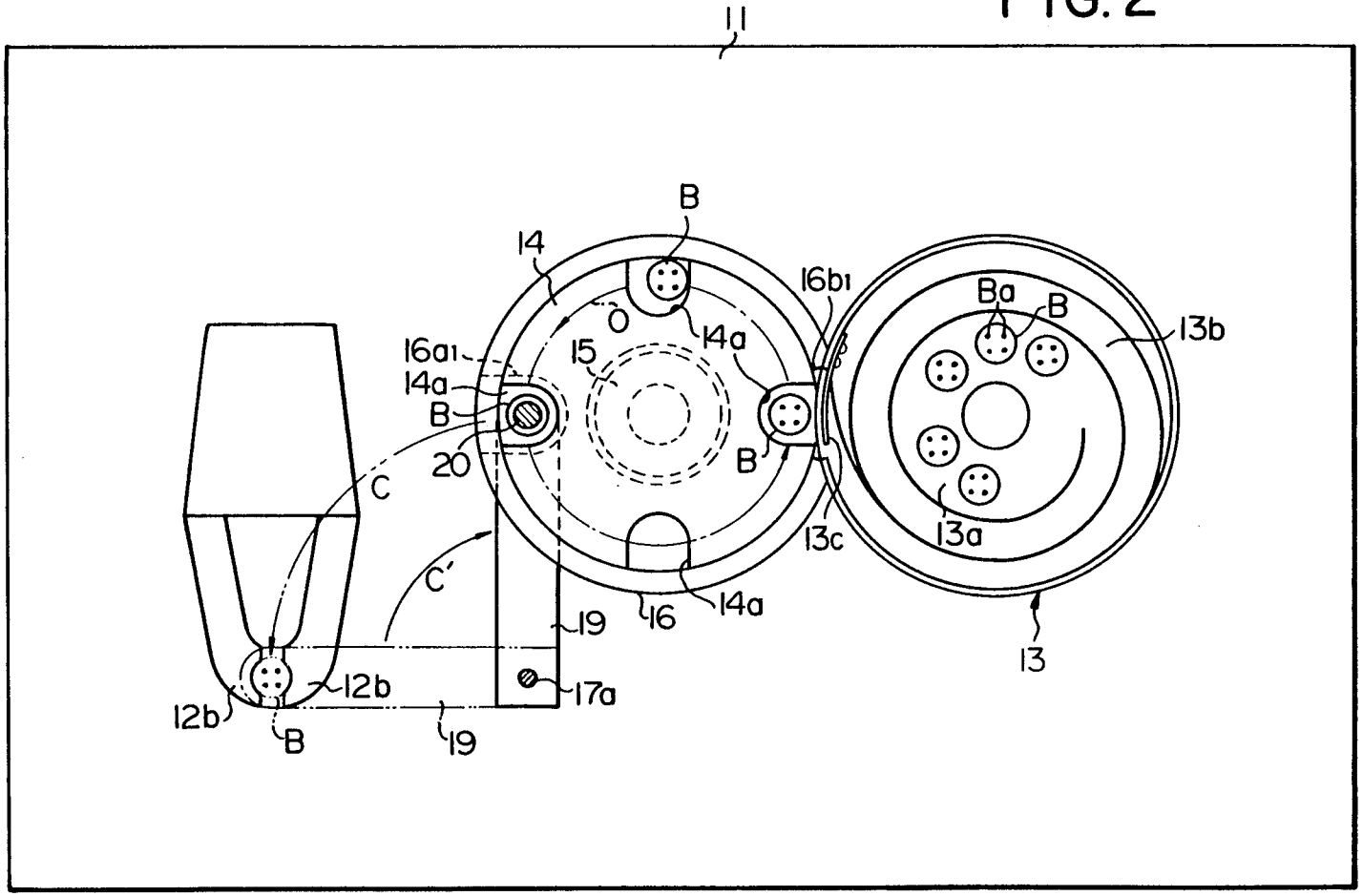
FIG. 2 is a plan view of the main part of the first embodiment of the invention.
Figure 3:
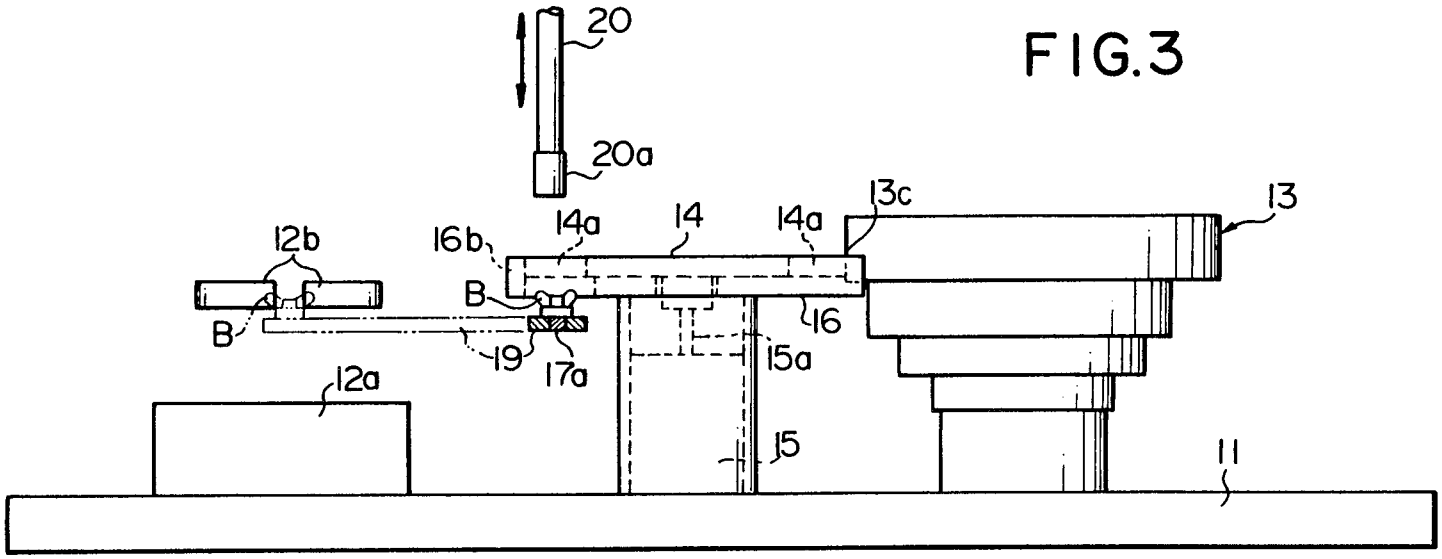
FIG. 3 is a front view of the main part of the first embodiment of the invention.
Figure 6:
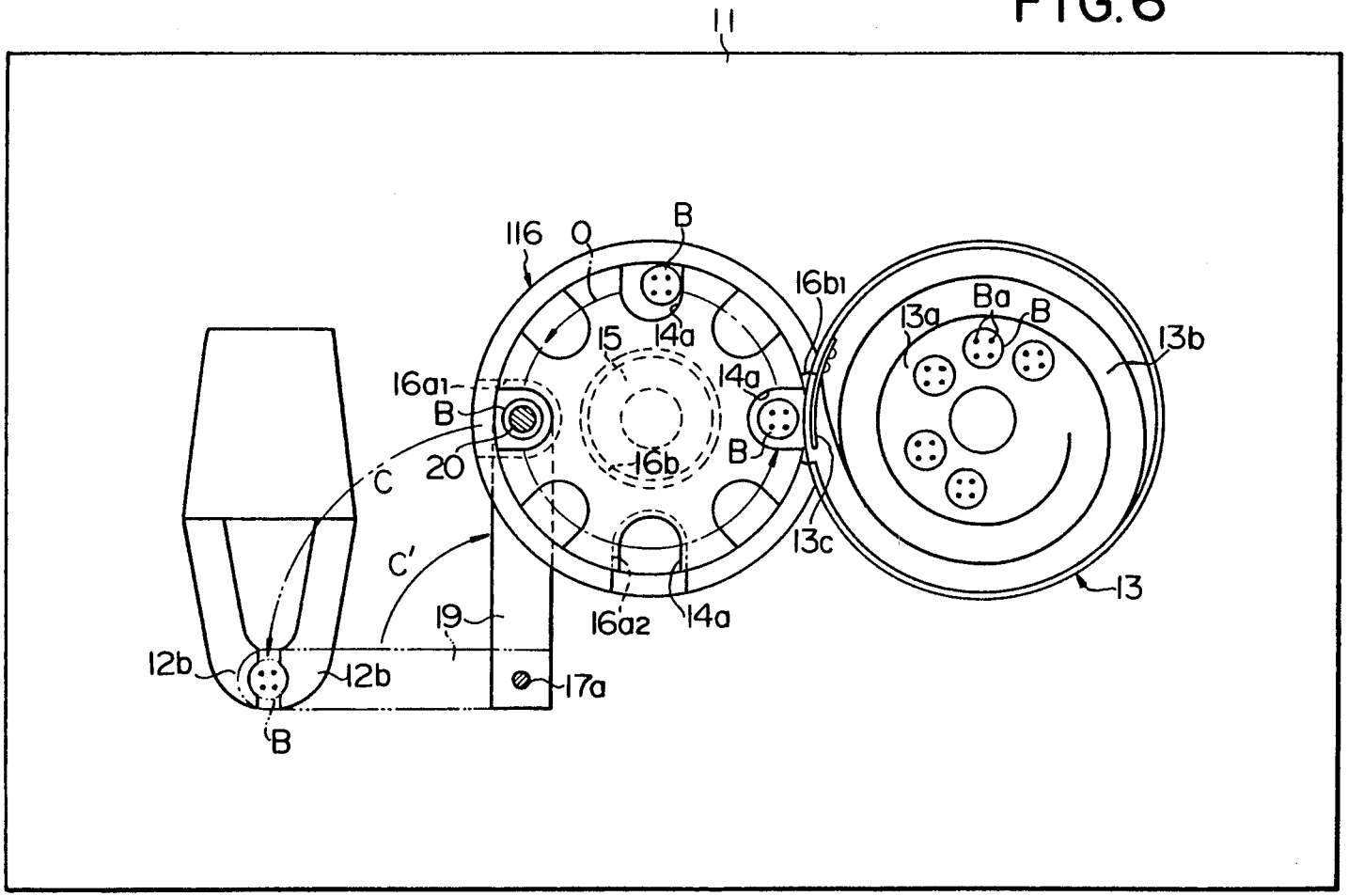
FIG. 6 is a plan view of the main part of a second embodiment of the invention.
Figure 7:
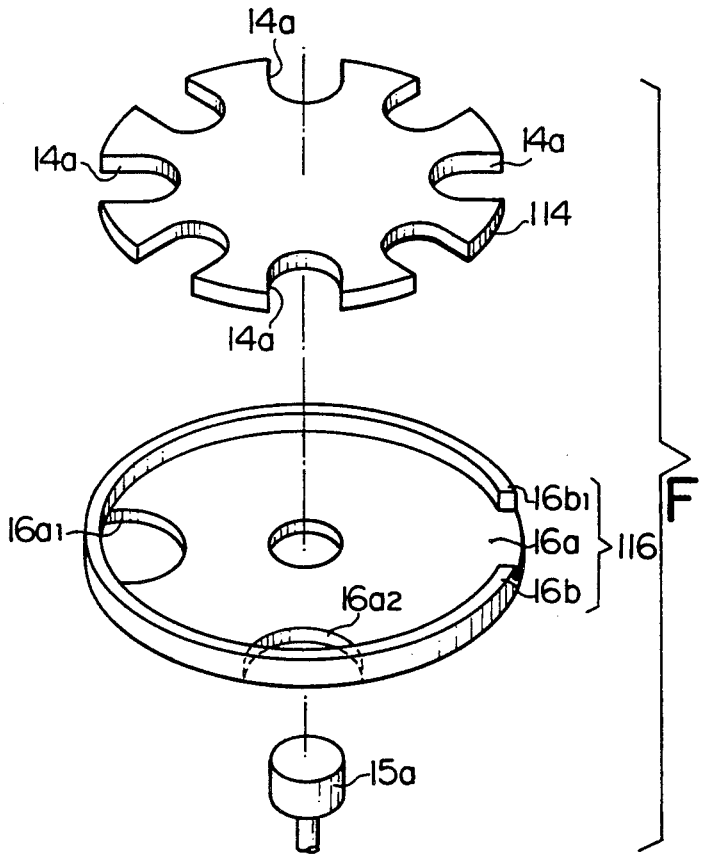
FIG. 7 is an exploded perspective view showing a rotary plate and a button support and a button receive disk according to the first embodiment of the invention.

Referring to FIGS. 1 through 5B, there is illustrated a first embodiment of the invention.

As shown, numeral 12 designates a button sewing machine which is disposed on a work bench 11 or sewing machine table and is provided with a button clamp (consisting of a pair of clamp arms **12*b*, 12*b*) which is so mounted so as to move vertically up and down and is adapted to horizontally support buttons B above a sewing machine bed 12*a*. Numeral 13 denotes a button storage unit or button feeder in the cylindrical form which is adapted to upwardly move the buttons B received in a bottom 13*a* thereof so as to progress upward along a spiral passage formed on the inner wall of the supply station by transmitting a predetermined vibration thereto. Eventually, the buttons B are successively discharged from a discharge hole 13*c*** with the button surface turning up.

A disc shaped rotary plate 14 is horizontally held on a motor 15 fixed to the work bench 11 and is adapted to be intermittently rotated with a motor shaft **15*a* at every $\frac{1}{4}$ revolution. The rotary plate 14 is formed with a plurality of recesses 14*a* circumferentially thereon (four in this instance), each of which is dimensioned for insertion of one button thereto. These recesses 14*a* are each formed to stop and align in proximity with the discharge hole 13*c* of the button storage unit or button feeder 13 when the rotary plate 14 is intermittently stopped. As seen from FIG. 4, a button support 16 is fitted over the rotary plate and is fabricated in a thin walled cylindrical form. The button support is defined by a circular bottom 16*a* and an annular rim 16*b* formed peripherally of the bottom 16*a*. The annular rim 16*b* includes a button inlet 16*b*1 to be opposed to the discharge hole 13*c* of the button storage unit or button feeder 13. The bottom 16 is in turn provided with an opening 16*a*1 in communication with each of the recesses 14*a*. In this instance, a position where it is farthest away from the discharge hole 13*c* of the button supply 13, that is, a position where each of the recesses 14*a* is rotated through 180° from the discharge hole 13*c* is set to a button discharge position where an opening 16*a*1 is formed in the button support 16. A button conveyor system is composed of the rotary plate 14, motor 15, and the button support 16**.

A further motor 17 is provided for rotating a swivel arm 19 as will be described later and is mounted on a support block 18 secured to the work bench 11. The motor 17 is rotated synchronously with intermittent rotation of the rotary plate 14 to counterclockwise and clockwise rotate a rotary shift 17 to a given extent of the angle. A swivel arm 19 is rigidly mounted on the lower end of the rotary shaft **17*a* and is horizontally swung bodily therewith. This swing movement will therefore move a button holder consisting of four pegs 19*a* formed on the arm at one end thereof between the underside of the opening 16*a*1 in the button support 16 and the clamp arms 12*b*, 12*b***.

Numeral 20 indicates a rotary presser or a button position correcting member in a rod form which is held for vertical movement and rotation. The button position correcting member 20 is connected by link members 21, 22 and gears 24, 25 to not only a rod **23*a* of cylinder 23 but also a rotary shaft 26*a* of motor 26. The button position correcting member is also adapted for vertical movement above the button discharge position in association with movement of the cylinder rod 23*a* and for rotation in cooperation with rotation of the rotary shaft 26*a*. It is noted that a button position correcting mechanism 27 comprised of the correcting member 20, link members 21, 22, cylinder 23, gears 24, 25 and the motor 26**.

In operation derived from the aforementioned arrangement, an individual button B discharged from the discharge port 13*c* in the button storage unit or button feeder is inserted into the recess 14*a* in the rotary plate 14 which temporarily stops adjacent the discharge hole 13*c* to have the back side of the button supported on the bottom 16*a* of the button support 16. As the rotary plate 14 is rotated, the individual button B is intermittently moved at every ¼ rotation along a horizontal annular track 0 being guided through the button support 16 by the annular rim 16*b*. At the time when the rotary plate 14 is rotated through ½ revolution, the button B travels from the opening 16*a*$_1$ in the button support 16 down the top of the button holder, viz., the tops of the pegs 19*a* and rests stationarily. At this moment, the cylinder 23 of the correction mechanism 27 is actuated to lower the correcting member 20 to abut against the surface of the button a high fiction member 20*a* mounted on the lower end thereof. At the same time, for rotation of the button position correcting member 20, the motor 26 is driven to rotate the button B on the pages 19*a* to align with and fit on holes Ba in the individual button, thereby positively holding the button in position on the swivel arm 19. The swivel arm 19 is then pivotally moved about the rotary shaft 17*a* in the direction of arrow C to force the button B into a pair of the button clamp arms 12*b*, 12*b* to hold it in position The button clamp arms 12*b*, 12*b* are once raised to remove the button B from the pegs 19*a* to thus pivotally move the swivel arm 19 in the direction of C' toward the underside of the opening 16*a*. The swivel arm is then caused to stand ready for holding the next button discharged from the opening or button discharge hole 16*al*.

As set forth herein, in this embodiment, the rotary plate 16 and swivel arm 19 are adapted to forcibly move the buttons B as discharged from the button storage unit or button feeder 13 one by one, thus feeding them to the sewing machine 12. For this reason, the buttons are unlikely to adhere to the path and get stuck with each other causing clogging therein even if the button is made, for example, of lightweight material or material apt to generate static electricity, thereby not only positively feeding the button B to the sewing machine 12 but also greatly reducing rate of loose sewing done by the sewing machine.

In addition, the transfer path of the button B, which is defined by the rotary plate 16 and the swivel arm 19 are made substantially horizontal so that the button storage unit or button feeder 13 is set to an extremely low position, that is, it is flush with the button clamp arms 12*b*, 12*b*. Consequently, the operator may sit in the chair CH in a normal position and readily inspect the remainder of the buttons in the button supply.

Further, in the aforementioned embodiment, the periphery of the rotary plate is encircled by the annular rim 16*b* of the cylindrical button support 16 to prevent the buttons from springing out due to a centrifugal force generated when the rotary plate 14 is rotated. This will positively move the button B along the horizontal annular track 0. If the annular rim 16*b* is set to the higher position, improvement in the prevention of button springing out may be obtained to accommodate the thicker button. In this instance, if a button feed cutout is so formed in the annular rim 16*b* as to face the discharge hole 13*c* of the button supply 13, the button supply may change in its height.

Notwithstanding, a through hole may be formed in substitution for the recess 14*a* in the rotary plate 14 to receive therein the button for somewhat expecting the advantage of prevention of the button springing out without providing the annular rim 16*b* for the button support 16. However, for accommodation of even the thicker button, the rotary plate 14 is required to increase its thickness to provide a wider through hole. In proportion with the increase in button thickness, the position of the discharge hole 13*c* in the button support 13 should be changed to the higher position. The disadvantage derived from the wider through hole is that the button is turned over when it falls to the through hole or is held tilted if the thin button is used. This will involve some difficulty in the design stage and limit application and performance of the button. In contrast, the aforementioned embodiment requires only simple and slight change in design in such a manner that the height of the annular rim 16*b* is increased and the cutout is formed to readily afford the desired performance and versatility.

The aforementioned embodiment has been described with respect to the four-hole button which requires the four pegs for the swivel arm 19. Of course, a two-hole button may be used if the pegs may be provided in number corresponding to the number of holes in the button to be fed.

It is to be understood that changes in certain specific dimensions such as an angle of intermittent rotation of the rotary plate, number of recess, positions of the discharge hole in the button support or button receive disk and the opening in the button support or button receive disk may be made, as the case may be. For example, the recesses 14*a* may be two or more or else five in number. In this instance, in order that the rotary plate stops its rotation to align the recess 14*a* with the discharge hole 13*c* and the opening 16*al*, the angle of intermittent rotation of the rotary plate 14 should be as expressed by the formula:

$$2\pi/a \cdot n$$

wherein a is a number of the recess, and n is an integer. In this connection, it is noted that when the recesses are odd numbers, the angle of intermittent rotation should be set to n value of odd number. Alternatively, a positional relation in a plane between the discharge hole 13*c* and the opening 16*a*1 should be changed.

It is also possible to select the recesses 14*a* out of the other recesses, as desired for use in button feeding to provide the recesses in numbers to a maximum. To this end, provision is made for varying the angle of intermittent rotation of the rotary plate 14 from 2/a (greatest numerical value required for the recess) to more or for setting a short down time at the time when the discharge hole 13*c* in the button storage unit or button feeder aligns with the opening 16*a*1 in the button support or button receiving disk with respect to the recesses which requires no receipt of the button.

A second embodiment of the invention will be described with reference to FIGS. 6 through 9B, wherein like reference characters designate like or corresponding parts throughout the views.

It is to be noted that elements and parts hereinafter identified are substantially the same as those described in connection with the first embodiment except for the configurations of the rotary plate 14 and the button support button receiving disk 16, and a control means shown in FIG. 8, which is not provided in the first embodiment.

More specifically, in the second embodiment, a rotary plate or disk 114 is adapted to intermittently rotate with the motor shaft 15*a* in one direction or the opposite direction by ⅛ revolution. Further, the rotary plate 114 is provided with eight recesses 14*a* through which the buttons pass. The button support 116 is formed in its first and second discharge positions with first and second openings 16*a*1 and 16*a*2 in communication with the respective recesses 14*a* when the rotary plate 114 is intermittently stopped.

In this instance, the first discharge position is so located on the button support as to part furthest away from the discharge hole 13*c* in the button storage unit or button feeder and the second discharge position is positioned intermediate between the first discharge position and the discharge hole 13*c* in the button storage unit or button feeder 13, that is, in a position where the one of the recesses 14*a* is rotated from the discharge hole 13*c* in one direction through an angle of 270° (in the opposite direction through an angle of 90°).

It will be noted that a button conveyor system is comprised of the rotary plate 114, the motor 15, and a button support 116.

Figure 8:
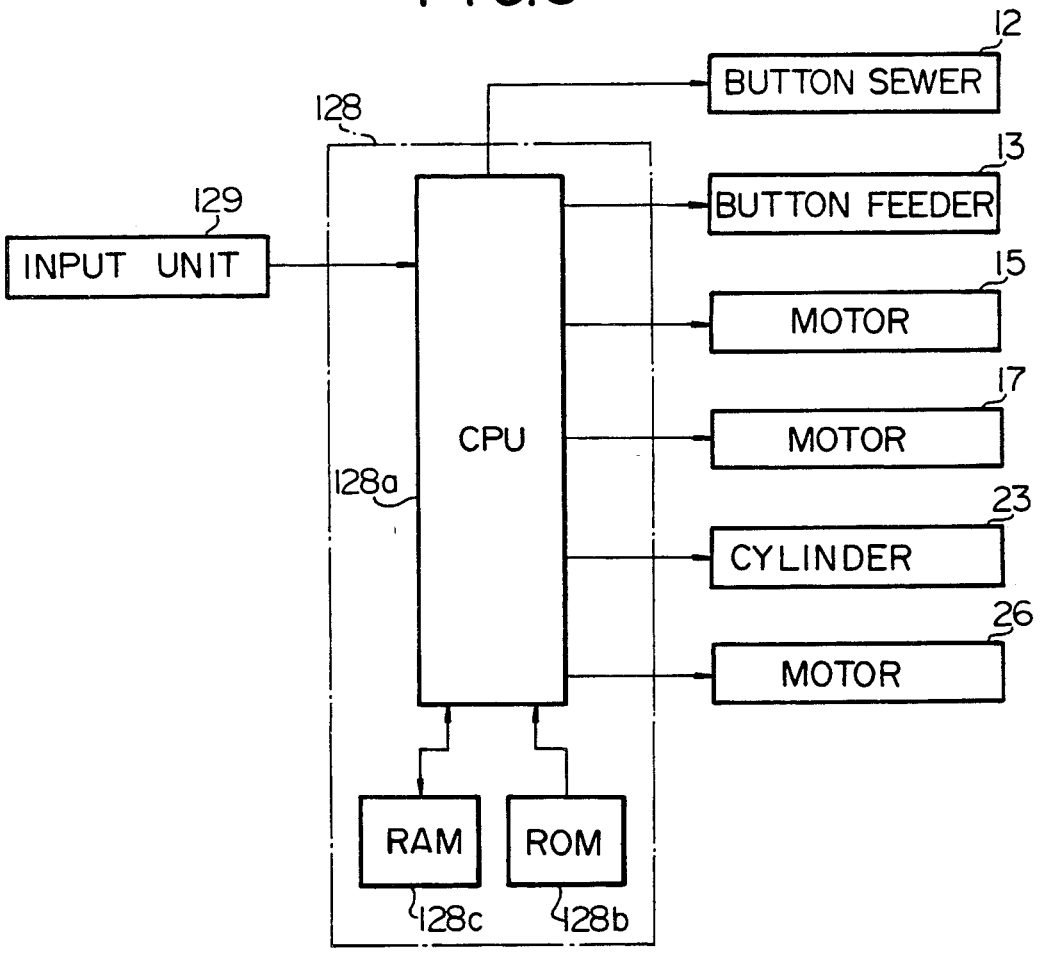
FIG. 8 is a block diagram showing a control means according to the second embodiment of the invention.

FIG. 8 illustrates a control means according to the instant embodiment. As shown, the control means comprises a well known microcomputer 128 which includes a CPU 128*a*, a ROM 128*b*, and a RAM 128*c* and the like. A control signal output from the control means serves to control drive of the button sewing machine 12, the button feeder 13, the motors 15, 17, and 26, and the cylinder 23 and the like. Numeral 129 indicates an input unit for inputting various commands such as a button feed starting command, a button discharge command and the like, and data to the CPU 128*a*.

Operation derived from the aforementioned arrangement will be apparent from the following description.

When the operator inputs the button feed starting command from the input unit 129 to the CPU 128*a*, the motor 15 starts its drive by means of the CPU to intermittently rotate in the direction of an arrow D by ⅛ revolution.

Figure 9A:
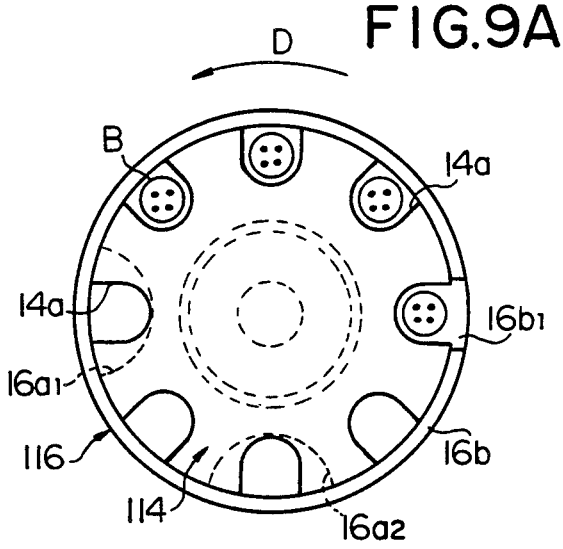
FIGS. 9A and 9B are plan views explanatory of the manner in which the buttons are fed and discharged, respectively, according to the second embodiment of the invention.

As is similar to the first embodiment, the rotary plate 114 is stopped for a moment whenever the recesses 14*a* successively align with the discharge hole 13*c* in the button feeder 13 to have the button B inserted into the recess 14*a* and held in the button support 116. The individual button B is intermittently relocated as the rotary plate 114 is intermittently rotated, as shown in FIG. 9A, to assume a position where the button is moved through an angle of 180° from the discharge hole 13*c*. At the same time, the individual button is dropped into the first opening 16*a*1 and is then supported on the pegs 19*a* of the swivel arm 19 positioned under the first opening 16*a*.

Now, the cylinder 23 and the motor 26 are operated subject to a control signal from the CPU 128*a* to rotate the high frictional member 20*a* and about the same against the surface of the button B. The button holes Ba are brought into alignment with the pegs 19*a* and are firmly held by the swivel arm 19.

The swivel arm 19 is then horizontally rotated in the direction of an arrow C by the motor 27 driven subject to the control signal from the CPU 128*a* to hold the button B between the clamp arms 12*b* and 12*b*. The clamp arms 12*b*, 12*b* are once raised to remove the button B from the pegs 19*a*. The swivel arm 19 is rotated (in the direction of an arrow C') to the original opening 16*a*1 thereunder.

It has previously been customary to pick up the buttons fed to the inside of the recesses 14*a* in the rotary plate 14 one by one when a different type of buttons are required for substitution for the buttons now in use according to a change in the material to be sewed. Occasionally, the button could not be picked up unless a pincette is used since a limited space is left between button B and the recess 14*a*. This involves much labor and provides less workability.

Figure 9B:
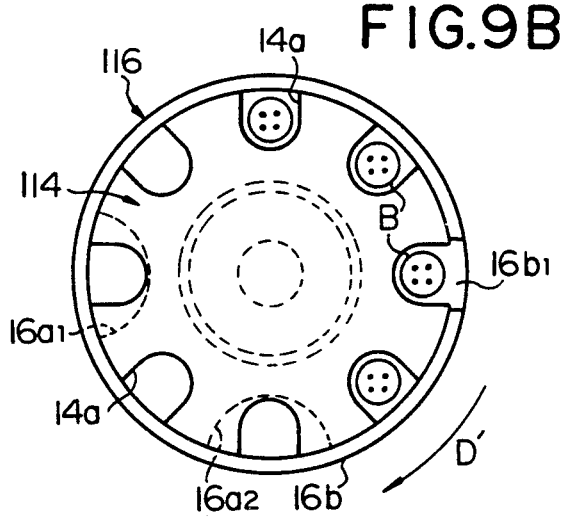

In contrast, according to the instant embodiment, the buttons are readily and automatically removed out of the rotary plate 14 by inputting the button discharge command from the input unit 129 through the operator. More specifically, the microcomputer 28 is actuated in response to input of the button discharge command to stop drive to the button feeder 13 and at the same time to drive the motor 15 to reversely rotate the rotary plate 14 as shown in FIG. 9B, thereby discharging the button from the recess 14*a* to the second opening 16*a*2 facilitating collection of the button as discharged.

In the same manner as in the first embodiment, the number of the pegs 19*a* of the swivel arm 19, angle of intermittent rotation of the rotary plate 114, position of the first opening 16*a*1, and the number of the recesses 14*a* may be varied.

The second opening 16*a*2 may be located in any position other than the position as illustrated in the second embodiment, for example, in such a position as rotated through an angle of 225° or 315°. in one direction of the rotary plate 14 from the discharge hole 13*c* so long as it is between the first opening 16*a*1 in the horizontal annular path 0 and the discharge hole 13*c* in the button feeder 13.

Figure 10:
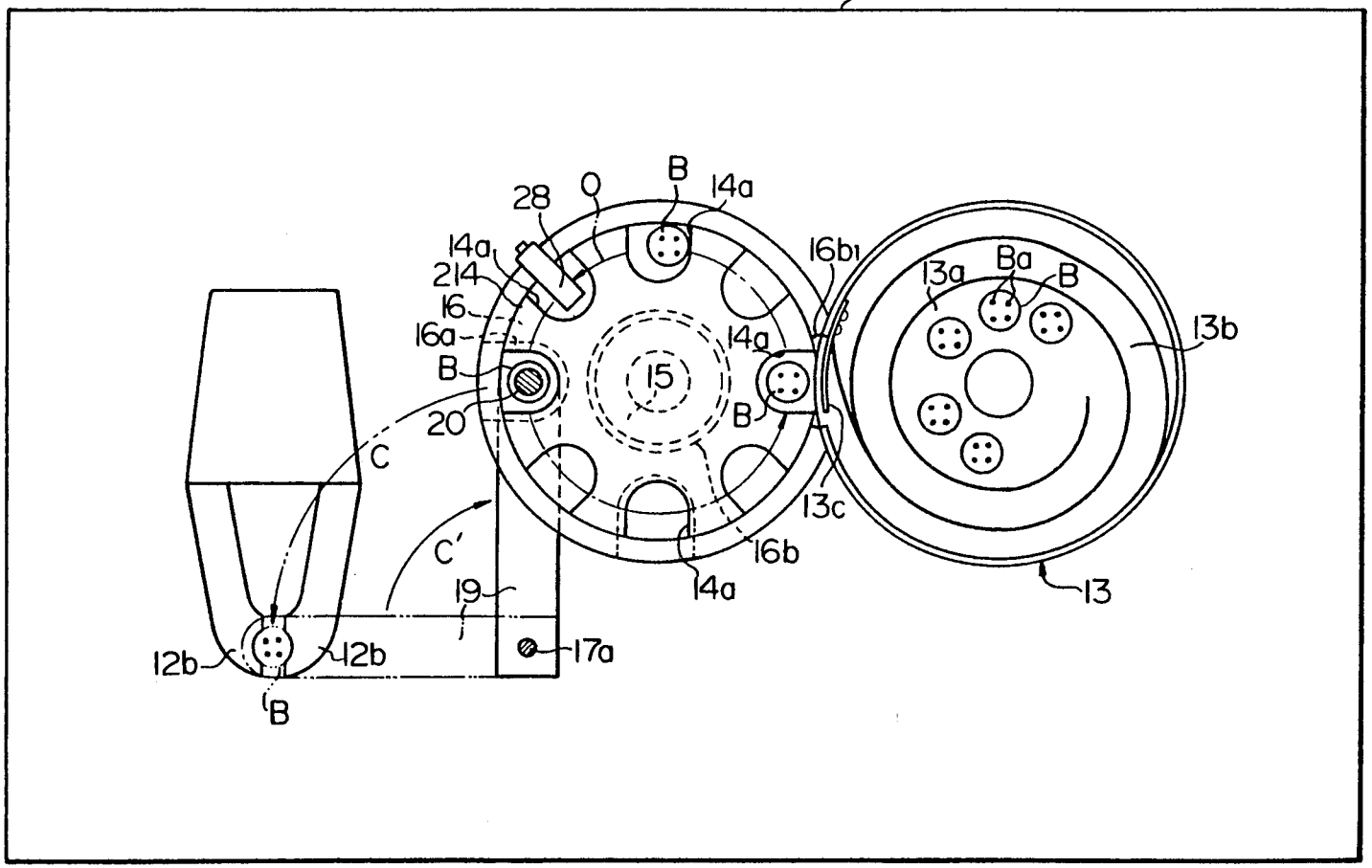
FIG. 10 is a plan view of the main part of a third embodiment of the invention.
Figure 11:
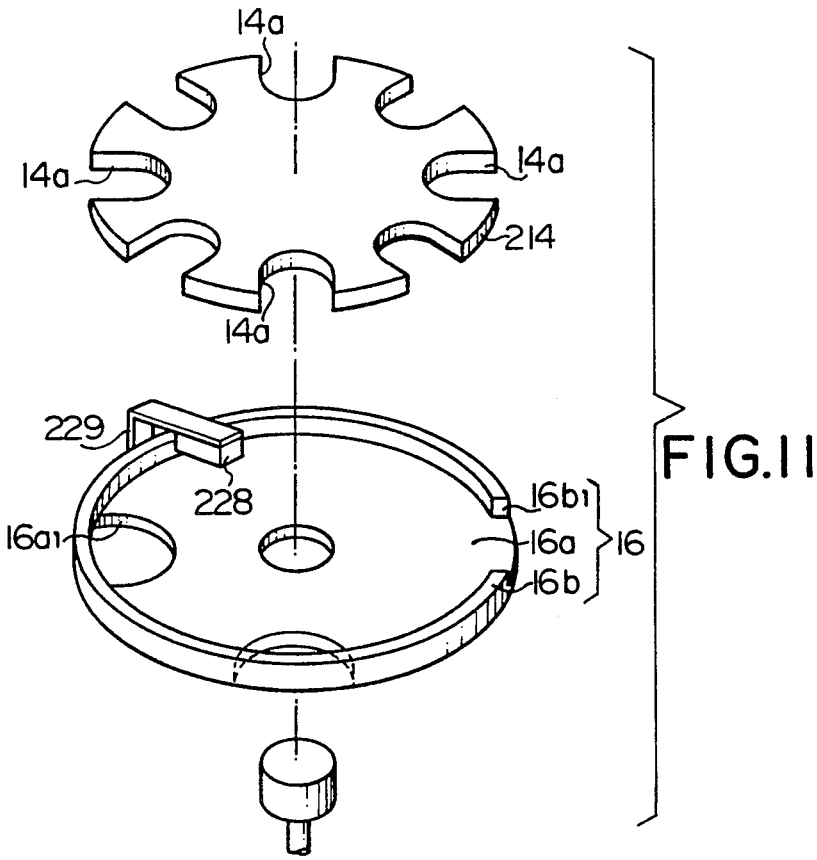
FIG. 11 is an exploded perspective view of a rotary plate and a button support in accordance with the third embodiment of the invention.
Figure 12:
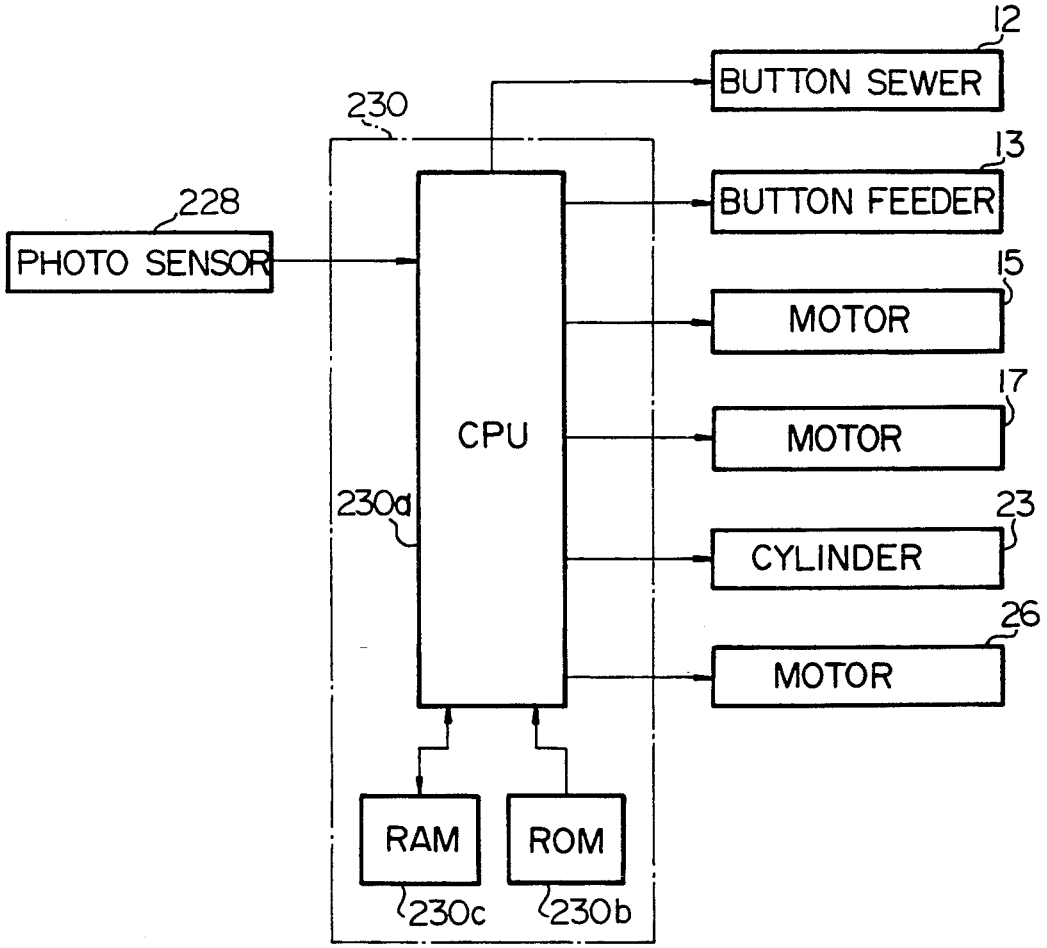
FIG. 12 is a block diagram showing a control means according to the third embodiment of the invention.
Figure 13:
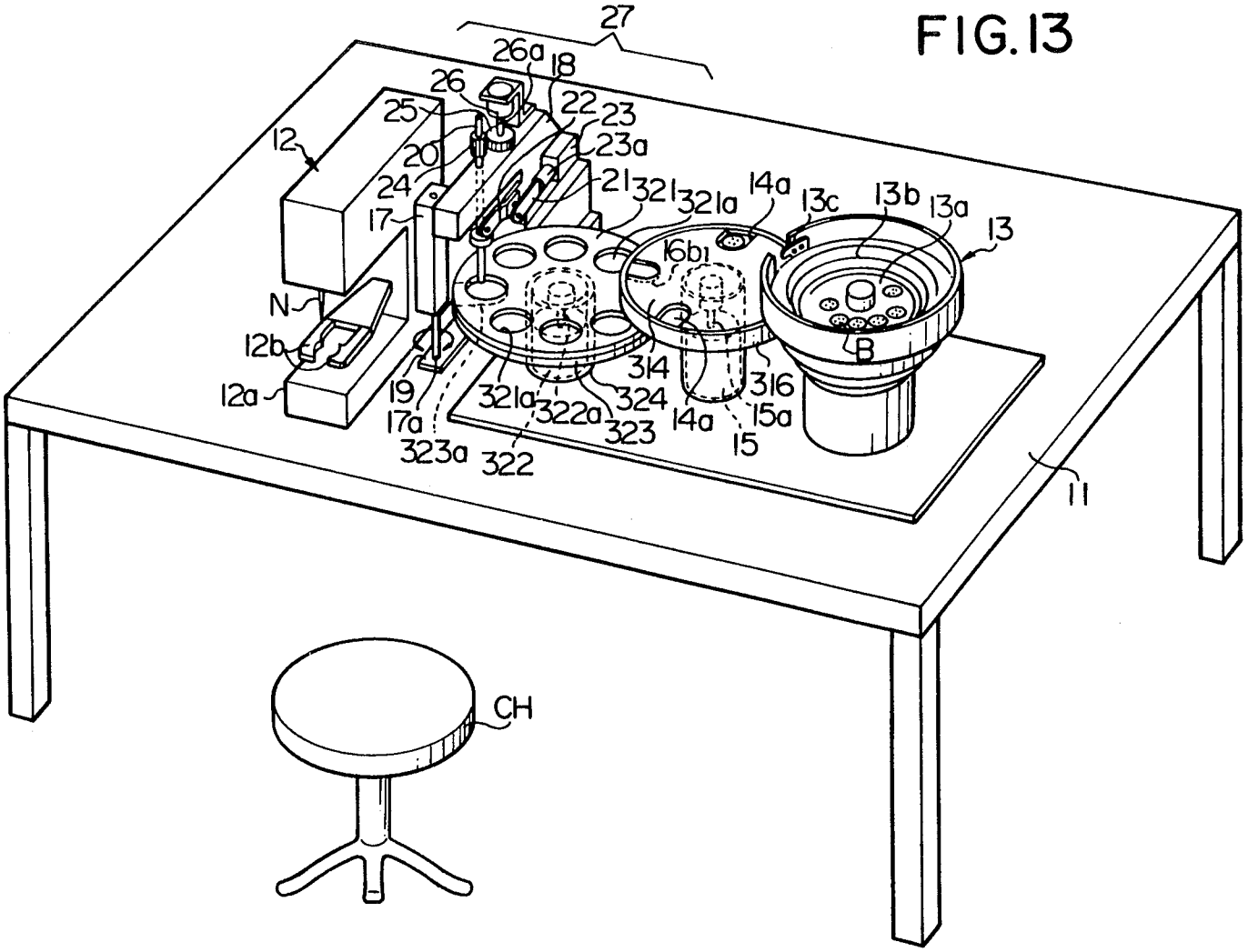
FIG. 13 is an isometric view showing a fourth embodiment of the invention.
Figure 14:
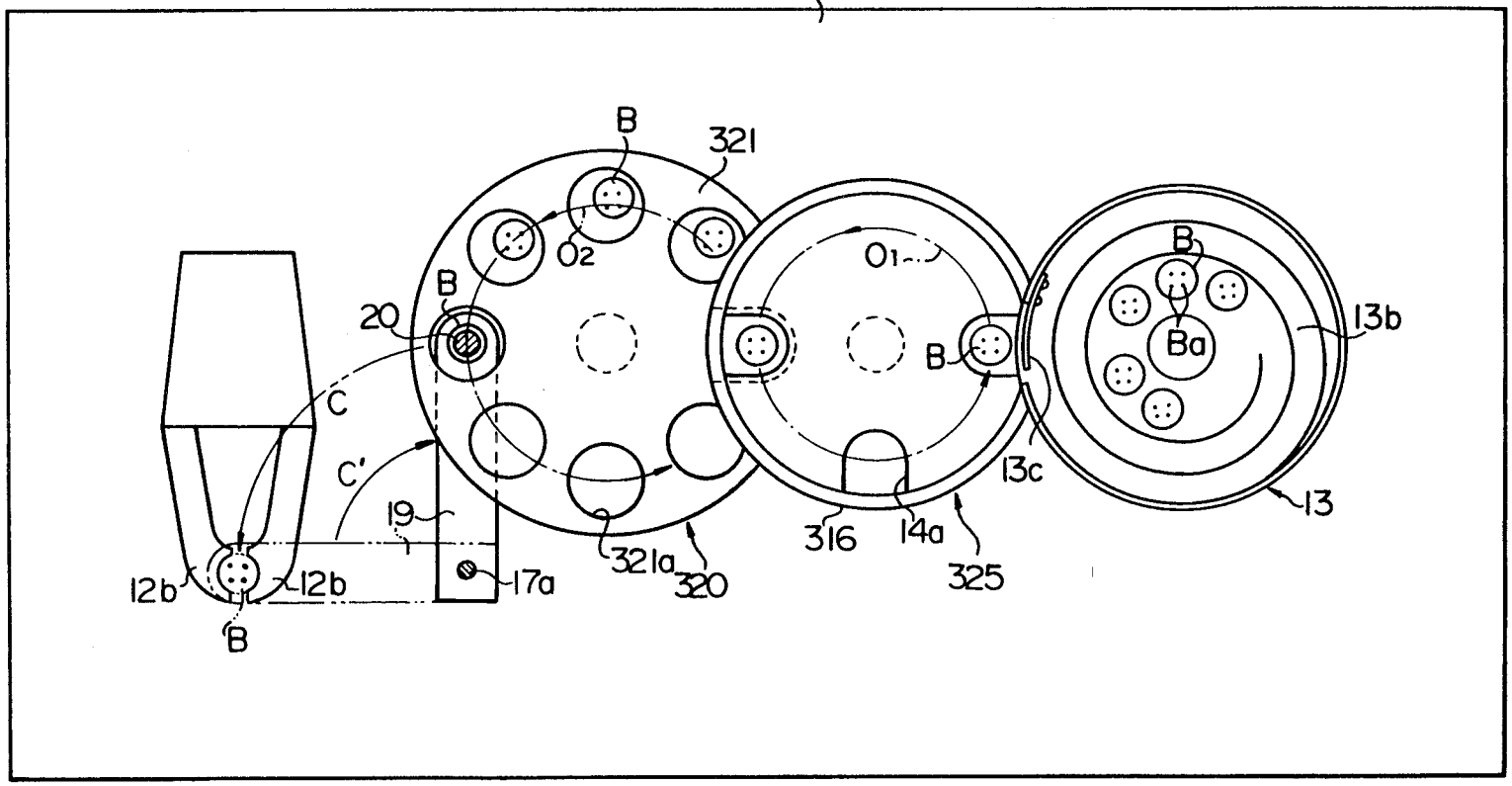
FIG. 14 is a schematic plan view of the fourth embodiment of the invention.
Figure 15:
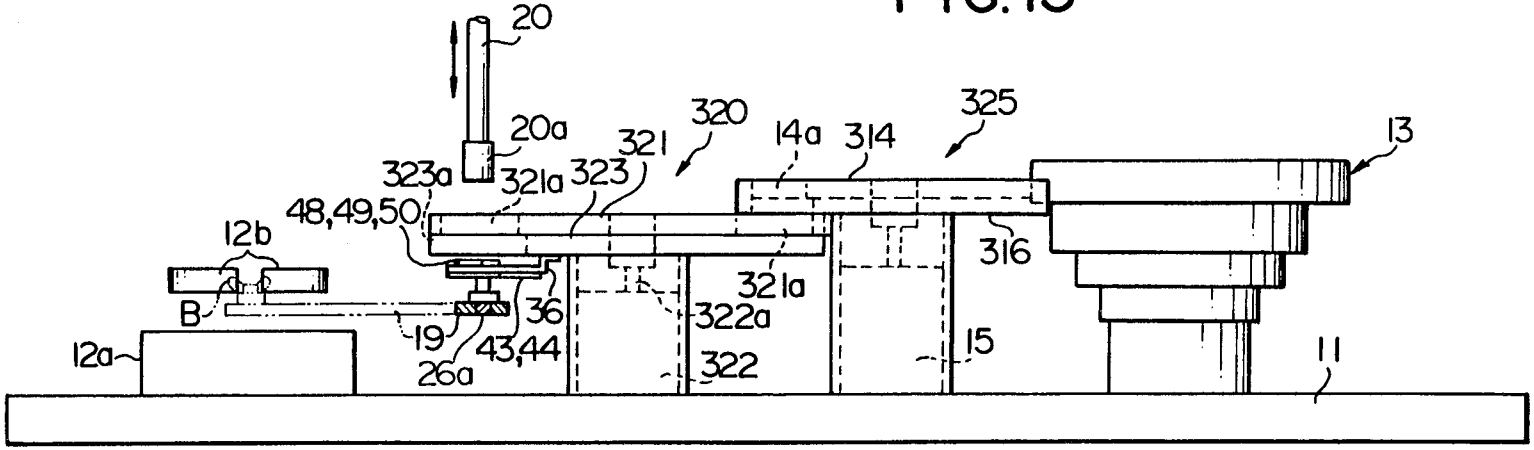
FIG. 15 is a front view of the fourth embodiment of the invention.
Figure 16:
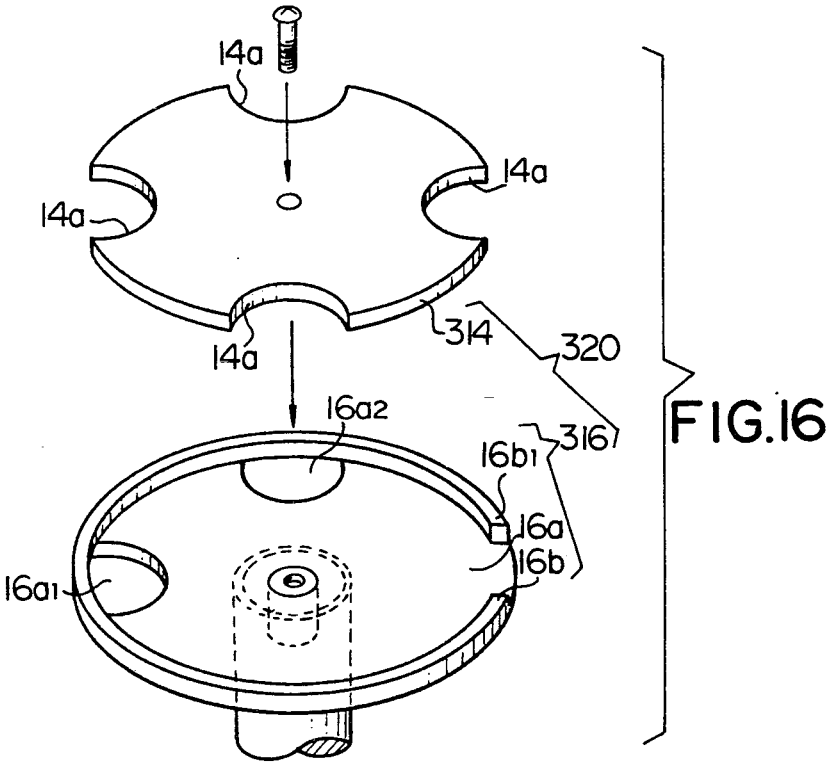
FIG. 16 is an exploded perspective view of a first rotary conveyance in accordance with the fourth embodiment of the invention.
Figure 19:
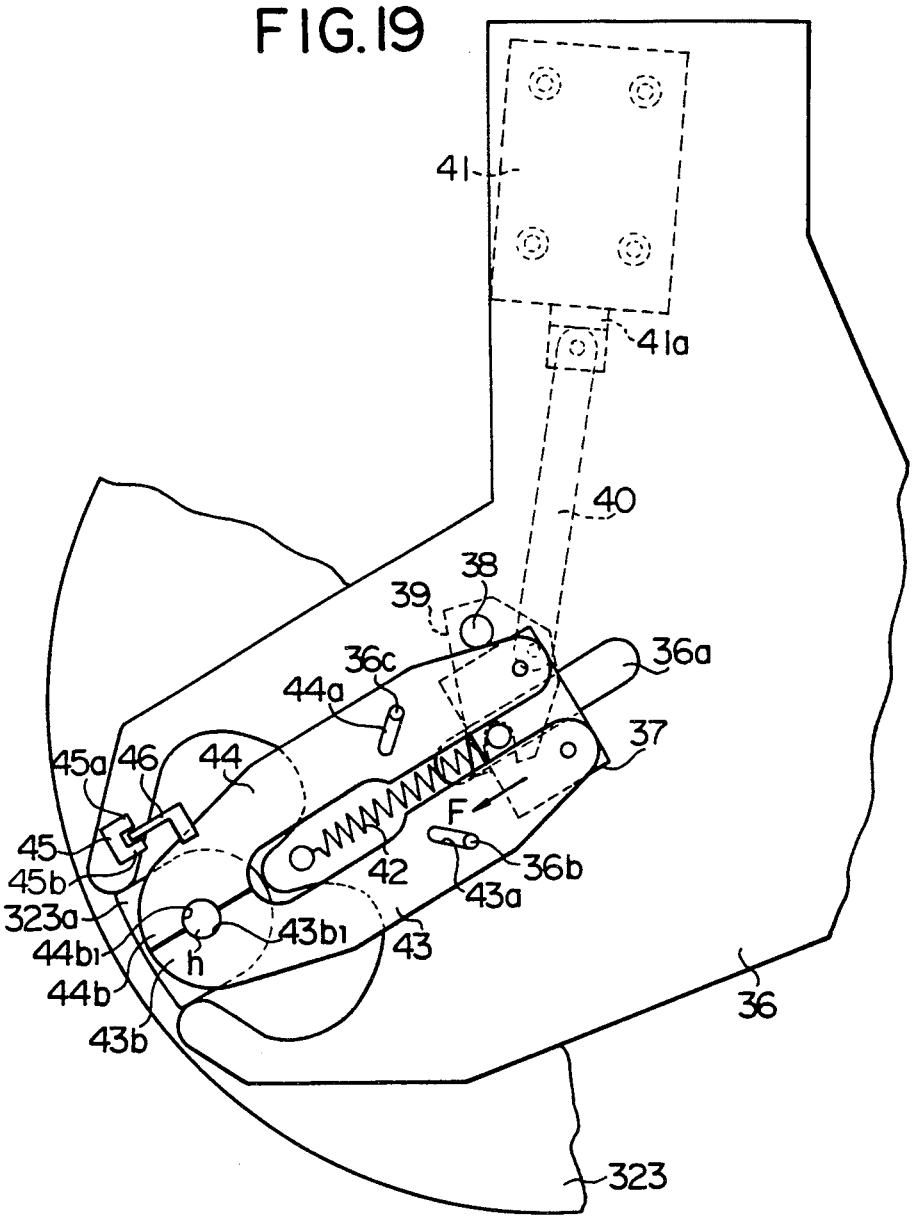
FIG. 19 is an end view showing an operative plate in accordance with the fourth embodiment of the invention.

A third embodiment of the invention will be described in conjunction with FIGS. 10 through 12, wherein like reference characters designate like or corresponding parts throughout the views.

It is to be noted that elements and parts hereinafter identified are substantially the same as those described in connection with the first embodiment except for a photo sensor 228, a control means 230, and eight recesses 14*a* in rotary plate 214 for passing the button therethrough.

A reflex type of photo sensor 228 is adapted to detect whether button B is in the recess 14*a* in the rotary plate 214 and is so fixed to the periphery of the button support 16 as to be positioned above the recess 14*a* when the rotary plate 14 is intermittently stopped. In this instance, the photo sensor is located above a position where the rotary plate is rotated until the recess 14*a* stops just before the discharge position. If the button is in the recess 14*a* when the rotary plate 14 is stopped, a button presence signal is generated, whereas, if the button is not in the recess to output, a button absence signal is generated. The output of the photo sensor 228 is input to a well known microcomputer 230 as a control means which comprises a CPU 230*a*, ROM 230, and a RAM 230*c* and the like, as shown in FIG. 12. The button sewing machine 12, button feeder 13, motors 15, 17, 26, and the cylinder 23 and the like are connected to the output side of the microcomputer 230. The CPU 230*a* is adapted to suitably control these elements and parts.

According to the first embodiment as aforementioned, the buttons if successively fed from the button feeder 13 to the interior of the respective recesses 14*a* in the rotary plate 214, are fed to the sewing machine 12 without fail.

Notwithstanding, it sometimes happens that some of the buttons in the button feeder 13 reach the vicinity of the discharge hole 13*c* turning inside out. If this condition lasts without any break, discharge of the buttons are interrupted for a moment. This moves the recess 14*a* to which the button B is not fed to the discharge position so that not only the swivel arm 19 and the position correcting mechanism 27 perform undesirable operation but also loose sewing is done by the sewing machine. However, in accordance with the third embodiment, the photo sensor 228 just ahead of the discharge position senses the presence of the button B in the recess 14*a* to establish the absence of the button. If so, the microcomputer stops the drive of motor 17, cylinder 23, and the button sewing machine 12 until the photo sensor outputs the button presence signal to thus preventing the swivel arm 19 and position correcting mechanism 27 from malfunctioning and the sewing machine from doing loose sewing. Further, the microcomputer 230 serves to control the motor 15 to reduce time required for rotation of the rotary plate 214 until the photo sensor 228 outputs the button absence signal. In this instance, the rotary plate 214 is adapted to reduce an intermittent stop time to less than the normal operating time (when the button presence signal is output). Accordingly, the rotary plate 214 is able to move the buttons B which have been again and successively fed to the interior of the recesses 14*a* toward the discharge position a short time after the button feeder 13 has failed to feed the buttons so that the button feed operation with respect to the sewing machine 12 can be quickly performed.

In the same manner as in the first embodiment, the number of pegs 19*b* of the swivel arm 19, angle of intermittent rotation of the rotary plate 214, position of the opening 16*a*1 number of the recess 14*a*, and position of the discharge hole 13*c* may be all varied, if desired.

Although the instant embodiment has been described with respect to the photo sensor 228 being disposed in a position where the rotary plate is intermittently stopped just before the discharge position, the photo sensor may be located in any position where the rotary plate is intermittently stopped so long as it is located between the discharge hole 13*c* and the discharge position.

According to the third embodiment, even if the button is not fed to the recess in the rotary plate due to interference of the button feeder, the photo sensor senses presence or absence of the button to allow its sensing output to have the control means prevent the swivel arm, button position correcting mechanism, and the bottom sewing machine from being driven. In addition, the control means is adapted to control rotation of the rotary plate to reduce the time required for rotation of the rotary plate and to move the button receiving recess to the discharge position at a high speed by means of the sensing output from the photo sensor. As a result, the button feed operation is readily started again even after interference of the button feed operation. This will prevent the sewing machine from loose sewing and significantly improve productivity.

A fourth embodiment of the invention will be described with reference to FIGS. 13 through 23, wherein like reference characters designate like or corresponding parts throughout the views.

It is to be noted that elements and parts hereinafter identified are substantially the same as those described in connection with the first embodiment except that a button conveyor mechanism comprises a first rotary conveyor 320 and a second rotary conveyor 325, and that other elements or parts 36–63 are added to the button position correcting mechanism 20–26.

The first rotary conveyor 320 consists of motor 15 fixed to the work bench 11, first rotary plate 314 horizontally held by the motor 15, and button support 316 fitted over the rotary plate 314. The first rotary conveyor 320 is similar to the button conveyor mechanism in structure shown in the first embodiment and dimensioned to provide a width less than twice the diameter of the button used to prevent a plurality of buttons from being inserted into one recess.

The second rotary conveyor 325 is composed of a motor secured to the work bench 111, a second rotary plate 321 horizontally held by the motor 322, and a second button support 323 fitted over the rotary plate 321.

The second rotary plate 321 is horizontally so held as to partially overlie the undersurface of the button supply 316.

The second rotary plate 321 is intermittently rotated with a motor shaft 322*a* at every $\frac{1}{8}$ revolution. It is noted that the first rotary plate 314 is intermittently rotated at every $\frac{1}{4}$ revolution synchronous with the $\frac{1}{4}$ revolution. The second rotary plate 321 is provided on its circumference with equally spaced eight openings 321*a* through which the button passes. Each of the openings 321*a* is dimensioned to provided a diameter larger than the width of the recess 14*a*. More specifically, the opening has the diameter more than twice the diameter of the smallest button to be used. The second rotary plate 321 is intermittently rotated so as to align each opening 321*a* with the first discharge hole 16*b*$_1$ in the first button support 316 when the second rotary plate 321 is intermittently stopped. Consequently, the first and second rotary plates 314 and 321 are intermittently stopped to thus align the corresponding opening 321*a* and recess 14*a* with the discharge hole 16*a*1 in the first button support 316 in communication therewith.

A second disk-like button support 323 is fitted over the second rotary plate 321 by a holder 324. The second button support 323 is formed circumferentially thereof with a second discharge hole 323*a* to communicate with one of the openings 321*a*. In this instance, an end position where the button is fed or conveyed is in a position where the button support 316 is rotated from the position of communicating with the first discharge hole 16*b*1 through an angle of 180°. This conveyor end position is provided with the second discharge port 323*a*. A second rotary conveyor 325 is formed of the second rotary plate 321 and the second button support 323 on one hand, and a button conveyor system is in turn formed of the second rotary conveyor 325 and the first rotary conveyor 320. A mounting plate 36 is mounted under the second button support 323 (FIG. 19) and is provided with an opening and closing drive plate 37 which is advanced or retracted on the undersurface thereof and along a slot formed on the drive plate.

The drive plate 37 is coupled to an operative rod 41*a* of a solenoid 41 by a rotary member 39 which is rotated about a shaft 38 and a link member 40 connected to the rotary member. When the operative rod 41*a* is retracted by operation of the solenoid 41, the drive plate is moved back by the link member 40 and rotary member 39. The drive plate 37 is normally urged forward by a spring 42 and is moved forwardly by the bias of the spring 42 when the solenoid is not operated. Numerals 43, 44 designate a pair of flexible operative plates the rear ends of which are rotatably mounted by pins to the under surface of the drive plate 37. Slots 43*a*, 44*a* are diagonally formed in the mid-portion of the operative plates 43, 44. The slots 43*a*, 44*a* are adapted to receive therein pegs 36*b*, 36*c* extending from the undersurface of the mounting plate 36. When the drive plate 37 is retracted, that is, the solenoid 41 is operated, the operative plates 43, 44 are horizontally rotated under control of the pegs 36*b*, 36*c* in the direction where they are moved close to each other (closed condition) so that the forward ends 43*b*, 44*b* serve to substantially close the lower part of the discharge port 323*a* of the second button support 323.

Figure 20:
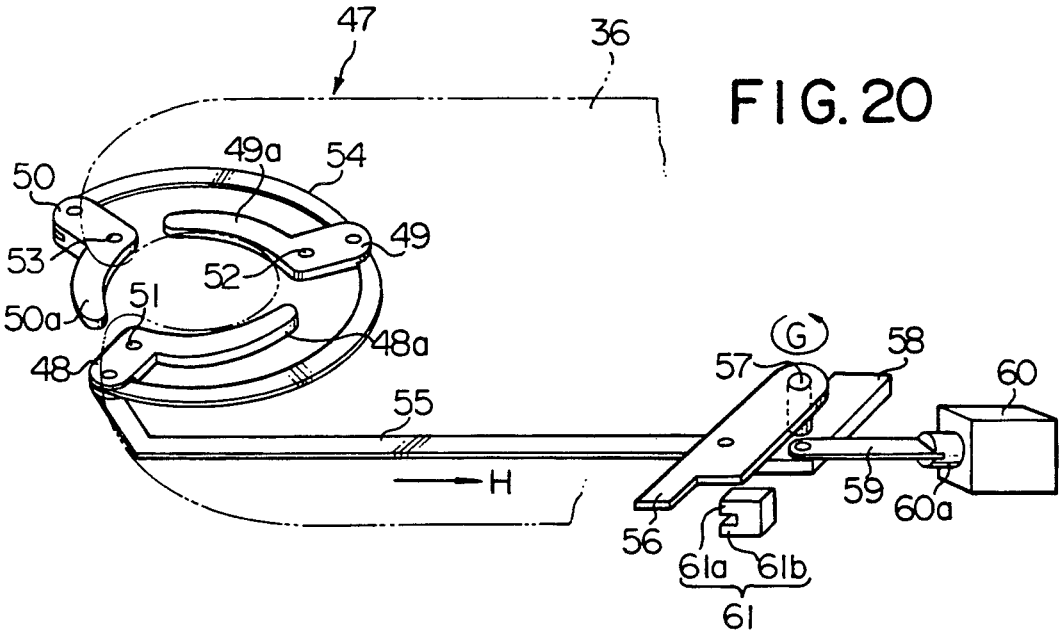
FIG. 20 is a perspective view showing a centripetal mechanism in accordance with the fourth embodiment of the invention.
Figure 21:
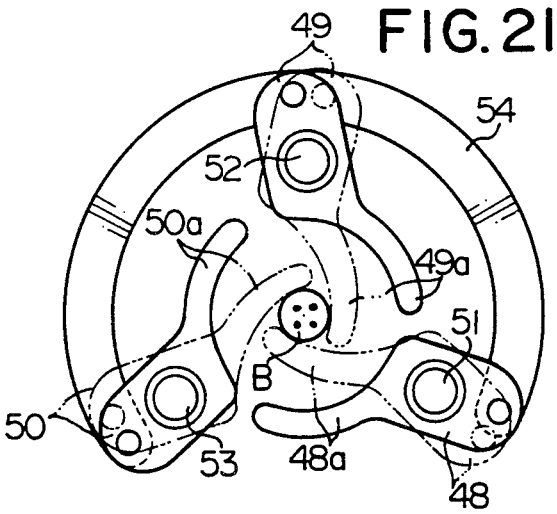
FIG. 21 is a plan view showing the manner in which the centripetal mechanism is actuated in accordance with the fourth embodiment of the invention.
Figure 22:
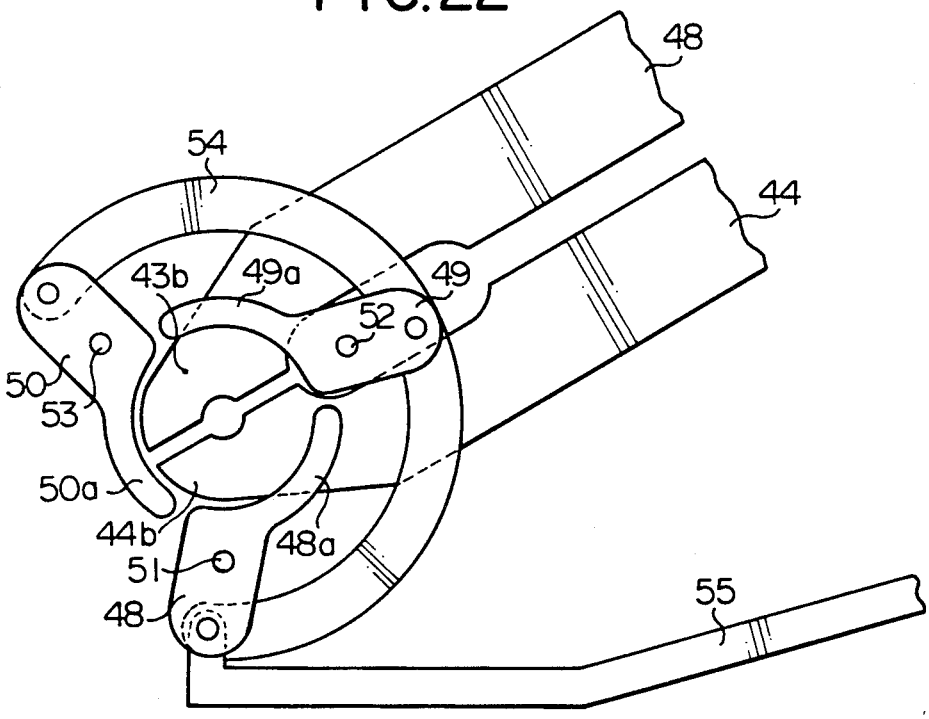
FIG. 22 is a block diagram showing a positional relation between the centripetal mechanism and the operative plate according to the fourth embodiment of the invention.

Semi-arcuated concaves 43*b*$_1$, 44*b*$_1$ are formed at the inner edges of the forward ends of the operative plates 43, 44 so as to be opposed to each other. A circular opening h which is defined by semi-arcuated concaves 43*b*$_1$, 44*b*$_1$ in the closed condition is positioned above the pegs 19*a*. A sensor 45 is provided for sensing whether the holes Ba in the button discharged upon the operative plates 43, 44 rightly align with the pegs 19*a*. The sensor 45 comprises a projecting element 45*a* and a light receptive element 45*b* which are disposed opposed to each other. The sensor 45 is adapted to sense whether an element 46 to be sensed which is provided on the undersurface of the other operative plate 44 is lowered between both the elements 45*a*, 45*b*. More specifically, downward deflection and flexure of the operative plate 44, which is derived from insertion of the pegs 19*a* into the holes in the button on the operative plate 44, is to be sensed by means of the element 46. As shown in FIG. 20, a centripetal mechanism 47 is arranged to align the center of the button B discharged upon the operative plates 43, 44 with the central axis of rotation of the button position correcting member 20.

As shown, three locator levers (mover) are rotatably mounted by support pins 51, 52, and 53 on the surface of the mounting plate 36 and positioned under the second button support 23. The locator levers are formed with arc-shaped 48*a*, 49*a*, 50*a* in the same arc form. The support pins 51, 52, 53 are equidistantly disposed on the circumference with the central axis of rotation of the button position correcting member 20 centered The arc-shaped segments 48*a*, 49*a*, 50*a* are dimensioned to define more than through hole 321*a* bored through a rotary plate 321. A locator link 54 in the arc form is formed with the locator levers 48, 49 and 50 one ends of which are mounted by pins on the link. The locator link 54 includes one end which is connected to an operative lever 55, link lever 56, rotary shaft 57, and an operative rod of a solenoid 60 by a connecting lever 58 and a link 59. When the operative rod 60*a* is retracted by actuation of the solenoid 60, the connecting lever 58, link lever 56, as well as the rotary shaft 57 are rotated by the link 59 in the direction of an arrow G to move the operative lever 55 in the direction of an arrow H and counterclockwise move the locator link 54.

As a result, the locator levers 48, 49 and 50 are all rotated counterclockwise about the support pins 51, 52, and 53 to equidistantly move the arc-shaped segment 48*a*, 49*a* and 50*a* inwardly. For this reason, the button B is eventually supported by the arc-shaped segments 48*a*, 49*a*, 50*a* and from three directions wherever the button is discharged upon the operative plates 43, 44 so that the center of the button B aligns with the central axis of rotation of the button position correcting member 20 without fail. It is noted that the centripetal mechanism 47 is formed with the aforementioned parts and elements. A sensor 61 is provided to sense presence or absence of the button inwardly of the locator links 48, 49, 50 when the latter are operated. The sensor 61 is in the form of a photo sensor which comprises a projector element 61*a* and light receipt element 61*b* and is adapted to sense one end of the link lever 56 which has been inserted in the two elements 61*a*, 61*b*. More specifically, the link lever 56 is inserted in the elements 61*a*, 61*b* only when the button is not present and the arc-shaped segments 48*a*, 49*a*, 50*a* of the locator link are moved inwardly farther when the smallest button is located.

Figure 23:
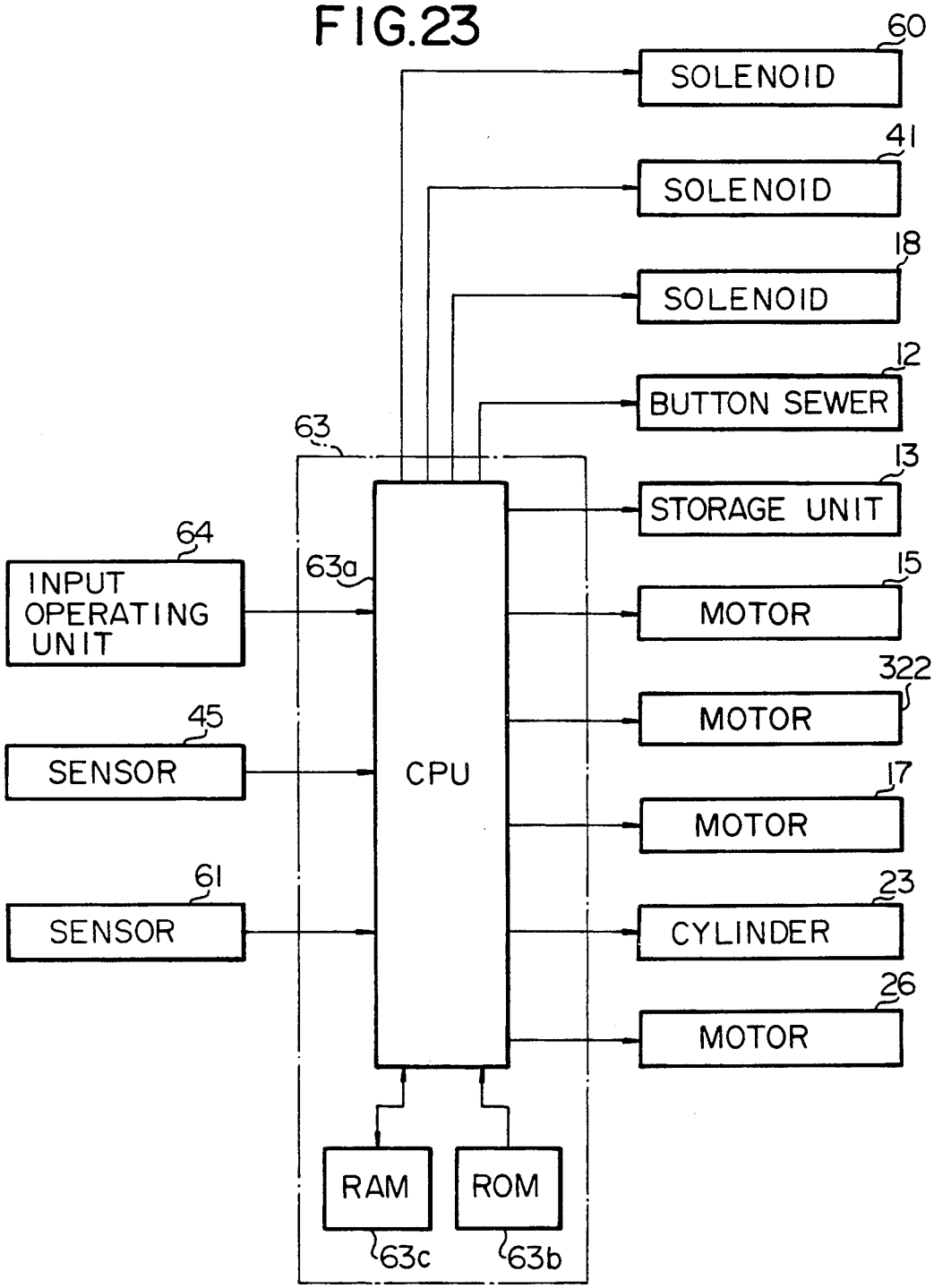
FIG. 23 is a block diagram showing a control means according to the fourth embodiment of the invention.

FIG. 23 is a block diagram showing a control means for controlling drive of the aforementioned parts and elements.

In the instant embodiment, the control means 63 is composed of a well known microcomputer 63 which consists of a CPU 63*a*, ROM 63*b*, and RAM 63*c* and the like. The CPU 63 is adapted to receive various input data transmitted from an input operating unit 64, and a detecting signal from the sensor 45, 61, and etc. as input thereto. With these inputs, the bottom sewing machine 12, button feeder 13, motors 15, 322, 26 and the cylinder 23 and the like are properly driven.

In operation, the button feed starting command is inputted from the input operating unit 64 to allow the CPU 128*a* to start the drive of the motor 15, 322, thereby intermittently rotating the first and second rotary plate 314, 321. The recesses 14*a* in the first rotary plate 314 successively align with and are stopped at the discharge hole 13*c* in the button feeder 13 while the individual button B discharged from the discharge hole 13*c* in the button feeder 13 is received in the recess 14*a* and held horizontally by the bottom 16*a* of the button support 316. The button fed to the inside of the recess 14*a* is guided by the annular rim 16*b* of the button support 316 and is intermittently rotated with the rotary plate 314 along a first horizontal arcuated path 01 every $\frac{1}{4}$ rotation. The button B reaches the first discharge hole 16*b*$_1$ at the time when the button is rotatably moved from the discharge port 13*c* of the button feeder 13 through an angle of 180° where the button drops into the opening 321*a* in the second rotary plate 321 which is intermittently stopped just under the corresponding recess 14*a*, and is then held by the second button support 323. In this manner, the button B is conveyed from the first rotary conveyor 320 to the second rotary conveyor 325.

The button delivered to the second rotary conveyor 325 is moved along a second arcuated path 02 by the second rotary plate 321 which is intermittently rotated at every $\frac{1}{8}$ rotation synchronously with the first rotary plate 314. The button reaches the convey end position at the time when it is rotatably moved from under the first discharge hole 16*b*$_1$ by $\frac{1}{2}$ rotation where the button drops from the second discharge hole 323*a* formed therein into the tip ends 43*b*, 44*b* of the operative plates 43, 44 in a closed condition. A button drop position is changed whenever the button B drops since the second discharge hole 323*a* and the opening 321*a* are so dimensioned as to provide a considerable size to accommodate even the maximum diameter of the button. This will involve misalignment of the button position correcting member 20 with the center of the button. This would be especially true of the button of a smaller diameter. Under such circumstances, the button is subjected to eccentric motion to fail to fit over the pegs 19 even if the button is rotated by the button position correcting member. The instant embodiment of the invention is designed so that upon discharging the button upon the operative plates 43, 44, the solenoid is actuated subject to the control signal of the CPU 63*a* to allow the centering levers 48, 49, and 50 to forcibly align the center of the button B with the central axis of rotation of the button position correcting member 20. Subsequently, the cylinder 23 and motor 26 are operated to lower the correcting member 20 to the surface of the button. With rotation of the correcting member, the button is rotated on the operative plates 43, 44. A downward movement of the correcting member, the operative plates 43, 44 are somewhat flexed to abut the upper ends of the legs 19*a* extended from the opening h against the underside of the button. When the button holes Ba align with the pegs 19*a*, the operative plates 43, 44 are considerably flexed by pressure force of the correcting member 20 so that the pegs are fitted into the button holes. Then, the sensor 45 is actuated to output a signal which shows engagement completion to the CPU 63*a* by which the solenoids 41, 60 are operated to close the operative plates 43, 44, thus moving the locator levers 48, 49, and 50 back to the initial position. The motor 17 is actuated subjected to the control signal of the CPU 63*a* to rotate the swivel arm 19 about the rotate shaft 17*a* in the direction of the arrow C, forcing the button B held by the pegs 19*a* into a pair of the button feeder 12*b* and holding it in position.

The instant apparatus according to the fourth embodiment is operated in such a manner as in the first embodiment.

It is noted that during the aforementioned button feed operation if the button is neither fed into the opening 321*a* in the second rotary plate 321 and nor is discharged from the second discharge hole 323*a* for some reason or other, the button absence signal is output from the button presence and absence sensor 61 by which the CPU 63*a* is prevented from driving the sewing machine 12, cylinder 23, and the motors 17, 26. With this arrangement, the instant embodiment is capable of eliminating loose sewing done by the sewing machine and undesirable operation of the swivel arm 19 and the button position correcting member 20 when the button feed is interfered with.

In the same manner as in the first embodiment, the number of the pegs 19*a* of the swivel arm 19, angle of intermittent rotation of the first and second rotary plate 314, 321, number of the recess 14*a* and opening 321*a*, positions of the discharge holes 16*a*2, 323*a*, and the discharge hole 13*c*, first opening 16*a*1, and the number of the recesses 14*a* may be varied, as needed. The buttons may also be conveyed from the button feeder 13 to the swivel arm 28 by more than three rotary conveyors.

Although the fourth embodiment has been described with respect to the operative plates 43, 44 formed of a flexible member, which is flexed when the pegs are fits into the button holes Ba, the operative plates 43, 44 may be formed of a rigid member of the swivel arm is raised in engagement of the pegs with the button holes.

While the invention has been described in its preferred embodiments, it is to be understood that the words which have been used are words of description, rather than limitation, and that changes may be made within the purview of the appended claims without departing from the true scope and spirit of the invention in its broader aspects.

What is claimed:

1. In a sewing apparatus having a button storage unit delivering buttons, one by one, to a sewing machine, a button transferring device for transferring a button from said storage unit to said sewing machine, comprising:

a button clamping device provided for clamping the button in a sewing position, a rotary disk having a plurality of button insert holes, a drive motor driving said rotary disk horizontally and intermittently, a button receiving disk, positioned under said rotary disk, for receiving the button thereon, said receiving disk having a first button discharge hole communicating with said button insert holes of said rotary disk to discharge the button, and an arm horizontally moving between said button discharge hole and said button clamping device, said arm having a button holder at the tip end thereof for holding the button discharged rom said first button discharge hole.

2. A device according to claim 1, further comprising a button align mechanism for aligning the button delivered from said first button discharge hole by said button holder.

3. A device according to claim 1, further comprising a controller to exchange a rotating direction of said rotary disk, said button receiving disk further including a second button discharge hole positioned between said first button discharge hole and said storage unit.

4. A device according to claim 1, further comprising a photo sensor to detect whether the button exists in said button insert hole, and a controller to stop the sewing machine when the button exists in said button insert hole.

5. A device according to claim 2, wherein said button align mechanism comprises:

a pair of plates to horizontally hold the button delivered from said first button discharge hole, a rotary presser vertically movable for pressing the button while rotating said button, and a centering means for aligning the button on said plates with said rotary presser.

6. In a sewing apparatus having a sewing machine, a button storage unit delivering buttons, one by one, to a sewing machine a button feeding device for feeding a button from said storage unit to said sewing machine, comprising:

a button, clamping device provided for clamping the button in a sewing position, a transferring mechanism for transferring the button delivered by said storage unit along a horizontal path to discharge the button at a fixed discharge position, said buttons being transferred in spaced relation to each other, an arm horizontally rotating between said discharge position and said button clamping device, said arm having a button holder at the tip end thereof, a button align mechanism for aligning the button discharged at said discharge position with said button holder, said transferring mechanism having a rotary disk including a plurality of button insert holes along said horizontal path, driving means for rotating said rotary disk horizontally and intermittently, and a button receiving disk positioned beneath said rotary disk, for receiving the button thereon, said button receiving disk having a discharge hole, at said fixed discharge position, communicating with said button insert holes of said rotary disk to discharge the button.

7. In a sewing apparatus having a sewing machine and a button storage unit delivering buttons, one by one, to a sewing machine, a button feeding device for feeding a button from said storage unit to said sewing machine, comprising:

a button clamping device provided for clamping the button in a sewing position, a transferring mechanism for transferring the button delivered by said storage unit along a horizontal path to discharge the button at a fixed discharge position, said button being transferred in spaced relation to each other, an arm horizontally rotating between said discharge position and said button clamping device, said arm having a button holder at the tip end thereof, a button align mechanism for aligning the button discharged from said transferring mechanism with said button holder, said transferring mechanism having a rotary disk including a plurality of button insert holes along said horizontal path, driving means for rotating said rotary disk horizontally and intermittently, and a button receiving disk fixed beneath said rotary disk, for receiving the button thereon, said button receiving disk having a first discharge hole at said discharge position communicating with said button insert holes of said rotary disk to discharge the button and a second discharge hole positioned between said first discharge hole and said storage unit, control means responsive to a button discharging signal for changing a rotating direction of said rotary disk, said control means rotating said rotary disk in a first direction to discharge the button from said first discharge hole in response to a button feeding signal, while said rotary disk reverses direction to discharge the button from said second discharge hole in response to a button discharge signal.

8. In a sewing apparatus having a sewing machine and a button storage unit delivering buttons, one by one a, to the sewing machine, a button feeding device for feeding a button from said storage unit to said sewing machine, comprising:

a button clamping device provided for clamping the button in a sewing position, a transferring mechanism for transferring the button delivered by said storage unit along a horizontal path to discharge the button at a fixed discharge position, said button being transferred in spaced relation to each other, an arm horizontally rotating between said discharge position and said button clamping device, said arm having a button holder at the tip end thereof, a button align mechanism for aligning the button discharged from said discharge position with said button holder, said transferring mechanism having a rotary disk including plurality of button insert holes along said horizontal path, driving means for rotating said rotary disk horizontally and intermittently, a button receiving disk positioned beneath said rotary disk, for receiving the button thereon, said button receiving disk having a discharge hole communicating with said button insert holes of said rotary disk to discharge the button, a photo sensor for detecting an existence of the button within said button insert hole at a predetermined position, and control means for accelerating the rotation of said rotary disk when said photo sensor does not detect the button to stop the movement of said arm, button align mechanism and sewing machine.

9. In a sewing apparatus having a sewing machine and a button storage unit delivering buttons, one by one, to the sewing machine, a button feeding device for feeding a button from said storage unit to said sewing machine, comprising:

a button clamping device provided for clamping the button in a sewing position, a transferring mechanism for transferring the button delivered by said storage unit along a horizontal path to discharge the button at a fixed discharge position, said button being transferred in spaced relation to each other, an arm horizontally rotating between said discharge position and said button clamping device, said arm having a pin at the tip end thereof, a button align mechanism for aligning the button discharged from said discharge position with said pin, said transferring mechanism comprising a plurality of rotary transferring units positioned between said storage unit and said discharge position, each transferring unit having a rotary disk including a plurality of button insert holes along said horizontal path, driving means for rotating said rotary disk horizontally and intermittently, and a button receiving disk positioned beneath said rotary disk and having a discharge hole communicating with said button insert holes of said rotary disk to discharge the button, the discharge hole of the transferring unit adjacent said arm being positioned at said discharge position, a pair of plates horizontally moving between said pin of said arm and said discharge hole to clamp the button, a rotary presser movable vertically for pressing the button on said pair of plates to rotate the same button, a centering mechanism provided on said plates to align the center of said button with the center of said rotating presser, each of said plates having a corresponding concave to form an aperture to receive therein said pin, and said centering mechanism having at least three members on said plates, each member simultaneously movable toward the center of said rotary presser to put the button in position.

* * * * *